United States Patent [19]

Hojnowski

[11] 3,976,037

[45] Aug. 24, 1976

[54] ROTARY ENGINE

[76] Inventor: Edward J. Hojnowski, 112 Lagana Ave., Plantsville, Conn. 06479

[22] Filed: Sept. 20, 1974

[21] Appl. No.: 507,932

[52] U.S. Cl. ..... 123/8.25; 418/175

[51] Int. Cl.[2] ..... F02B 53/00

[58] Field of Search ..... 123/8.25, 8.33, 8.35, 123/8.43; 418/6, 12, 92, 175, 176, 208

[56] References Cited

UNITED STATES PATENTS

| | | | |
|---|---|---|---|
| 1,790,256 | 1/1931 | Wright | 123/8.35 X |
| 1,849,398 | 3/1932 | Bracco | 123/8.35 |
| 2,500,458 | 3/1950 | Hinckley | 418/92 X |
| 2,699,151 | 1/1955 | Barrett | 418/6 X |
| 3,008,457 | 11/1961 | Mezzetta | 123/8.35 |
| 3,230,938 | 1/1966 | Hojnowski | 123/8.43 X |

FOREIGN PATENTS OR APPLICATIONS

| | | | |
|---|---|---|---|
| 1,094,785 | 12/1954 | France | 123/8.35 |
| 474,697 | 4/1929 | Germany | 123/8.43 |
| 960,103 | 6/1964 | United Kingdom | 123/8.43 |

*Primary Examiner*—Carlton R. Croyle
*Assistant Examiner*—Michael Koczo, Jr.
*Attorney, Agent, or Firm*—McCormick, Paulding & Huber

[57] ABSTRACT

A rotary engine has an annular stator and an externally rotating rotor, as well as an internally counter-rotating hollow shaft. Compression and expansion chambers are defined at the boundaries between the stator and said rotor and shaft respectively. Triangular valves are provided in circumaxially spaced openings in the stator so as to selectively place the compression and expansion chambers in communication with one another. Each such valve is pivotally mounted adjacent one of its apexes, and has inner and outer sealing surfaces defined adjacent its other two apexes respectively. The outer sealing surface engages the rotor to define the expansion chamber, whereas the inner sealing surface engages the hollow shaft to define the compression chamber. A hollow post pivotally supports each valve and provides fluid for lubrication and cooling to the interior of the valve. The rotor and hollow shaft are preferably made each in one piece, and the valve itself is preferably made of two pieces to accommodate varying thermal rates of expansion between the stator, the rotor and the shaft. The triangular valves are self operating in response to rotation of the rotor and shaft which are driven in opposite directions through a planetary gear system.

12 Claims, 8 Drawing Figures

ROTARY ENGINE

BACKGROUND OF THE INVENTION

This invention relates generally to internal combustion engines of the type shown and described in my prior U.S. Pat. No. 3,230,938 issued Jan. 25, 1966, and this invention deals more particularly with improvements to the rotary engine described in said prior patent, particularly in the area of the valve elements which control the respective sizes of the compression and expansion chambers as the rotating parts of the engine complete their respective cycles.

SUMMARY OF THE INVENTION

The invention described herein resides in a rotary engine of the type which includes an annular stator, which is preferably held stationary, said stator having a plurality of circumaxially spaced openings extending radially therethrough, a hollow shaft rotatably received inside the stator and cooperating with the internal cylindrical surface of the stator to define at least one inner cavity or chamber, and an outer rotor mounted for rotation outside the stator and cooperating therewith to define at least one outer cavity or chamber. In accordance with the present invention triangularly shaped valve elements are provided in each of these stator openings, and each valve has an inner, and an outer sealing surface defined at the inner and outer apexes of such triangular valve element. These sealing surfaces engage, respectively, the hollow shaft and the outer rotor. Each such triangular valve element is pivotally supported adjacent its third apex and is oscillatable in the plane defined by its apexes in response to rotation of the shaft in one direction and the rotor in an opposite direction.

Thus, the general aim of the present invention is to provide an improved valving arrangement in a rotary internal combustion engine of the type shown and described in my prior U.S. Pat. No. 3,230,938. This aim is achieved as a result of adopting the valve structure to be defined more completely herein, and the rotary engine itself is further improved by providing integral one piece hollow shaft and rotor constructions respectively. The valve itself is preferably fabricated from at least two parts so as to accommodate different rates of thermal expansion between the stator, and the counter rotating shaft and rotor respectively.

DETAILED DESCRIPTION

Figure 1:
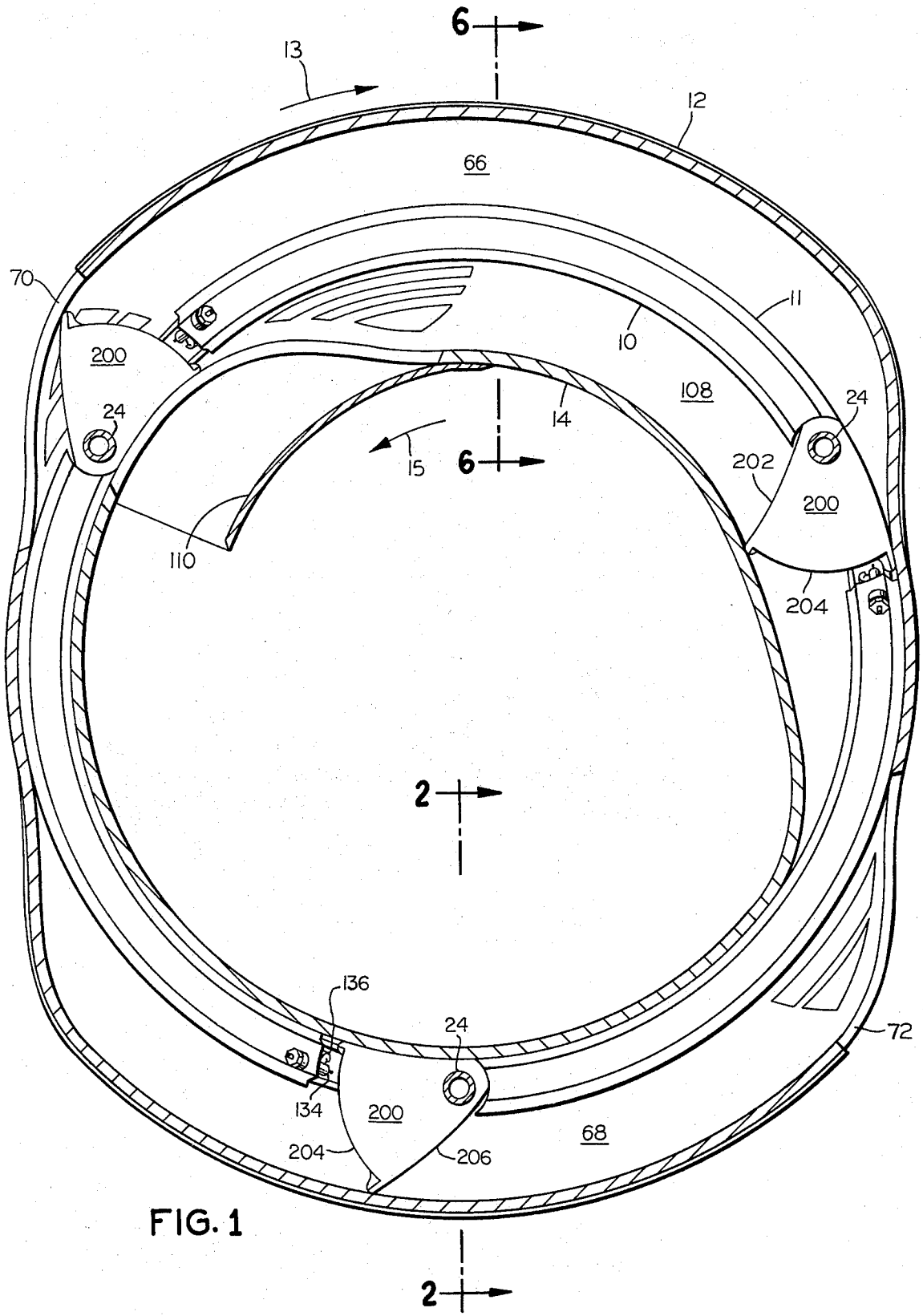
FIG. 1 is a horizontal sectional view illustrating the internal hollow shaft together with the fixed annular stator and associated outer rotor of the present invention in conjunction with three oscillating triangular valves provided in openings in the annular stator.

The basic rotary engine shown in FIG. 1 corresponds generally to that shown and described in the above mentioned prior U.S. Pat. No. 3,230,938 issued Jan. 25, 1966 to the inventor herein. As there described, this type of rotary engine comprises a stationary annular stator 10 the external cylindrical surface of which rotatably supports a generally annular rotor 12 turning in the direction of the arrow 13. The rotor 12 has recesses defined therein which cooperate with the cylindrical external surface 11 of the stator 10 to define a pair of expansion chambers indicated generally at 66 and 68 in FIG. 1. The interior cylindrical surface of the stator 10 rotatably supports a hollow shaft 14 which is also recessed to cooperate with the internal cylindrical surface of the stator in order to define a single compression chamber 108. Like the outer rotor 12 the inner hollow shaft 14 rotates, but in the opposite direction as indicated generally by the arrow 15 in FIG. 1.

In the embodiment shown, one such inner chamber or cavity 108 is provided, and two outer chambers or cavities are defined so that the relative angular speeds of rotation of the outer rotor and inner shaft, 12 and 14 respectively, bear a relationship of 1/2 to one another. As in the prior art patent referred to above, this angular speed and counterrotation relationship is achieved through a planetary gear train which includes an outer ring gear 20 defined in the rotor and best shown in FIG. 2, a planetary gear 22 rotatably mounted on a fixed vertically oriented shaft 24, which shaft is mounted in the fixed annular stator 10 so that a third gear in the form of a sun gear 26, carried by structure associated with the inner or hollow shaft 14, achieves the desired direction and speed of angular rotation for the inner shaft and outer rotor 12.

Again with reference to FIG. 1, the inner hollow shaft 14 defines an intake or inlet scoop 110, which scoop rotates in the direction of the arrow 15 so as to capture a charge of air in the chamber 108 defined not only by the recessed periphery of the hollow shaft 14 and the inner cylindrical surface of the stator 10, but also defined and limited in part by an inner surface 202 of a triangular valve element 200. Three such valve elements are provided in as many openings in the annular stator 10, and it will be apparent that as the shaft 14 rotates in the direction of the arrow 15 these valve elements 200, 200 cooperate with the single inner cavity or chamber 108 to trap a charge of air therein which charge is transferred radially outwardly through one of the valve openings provided for this purpose in the annular stator. At the desired point in time during the cycle of operation of the engine the charge is ignited preferably by a glow plug or spark plug indicated schematically in FIG. 1 at 134. A fuel injection nozzle 136 is provided to mix the appropriate quantity of fuel with the air charge. Once combustion has taken place power is derived from the exploding charge as it expands into one or the other of the expansion chambers 66 and 68. The products of combustion are evacuated as a result of continued rotation of the outer rotor 12 in the direction of the arrow 13 through the exhaust ports, 70 and 72 respectively, provided for this purpose in the outer rotor.

Having thus briefly described the overall operation of the rotary engine depicted in the drawings, which description corresponds generally to that of the rotary engine shown and described in my prior U.S. Pat. No. 3,230,938, the differences between the improved rotary engine shown and described herein will be emphasized over and above the disclosure in such prior patent.

Figure 4:
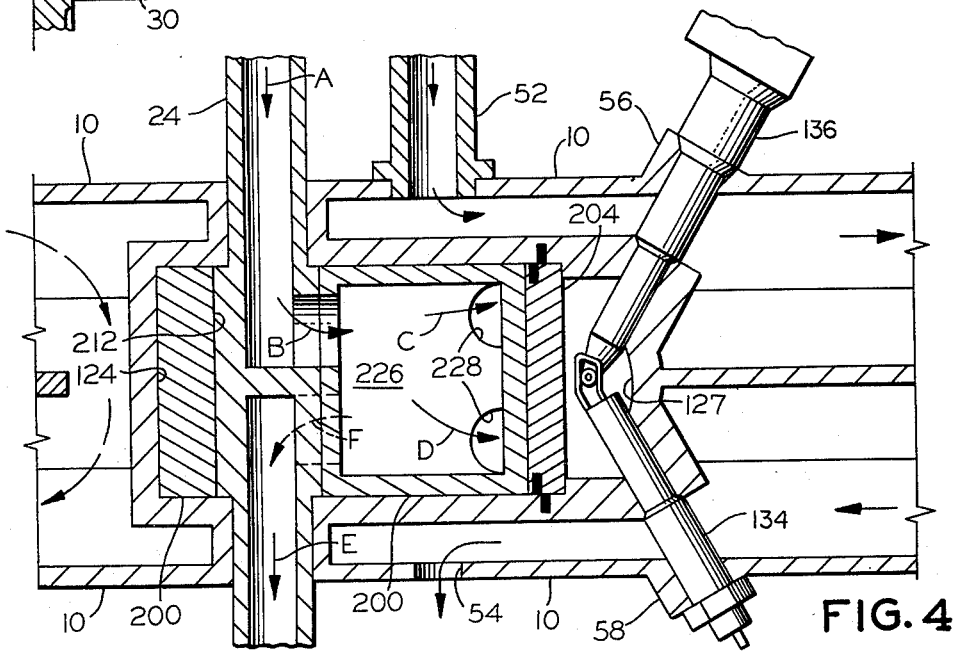
FIG. 4 is a vertical sectional view taken generally on the line 4—4 of FIG. 3.
Figure 3:
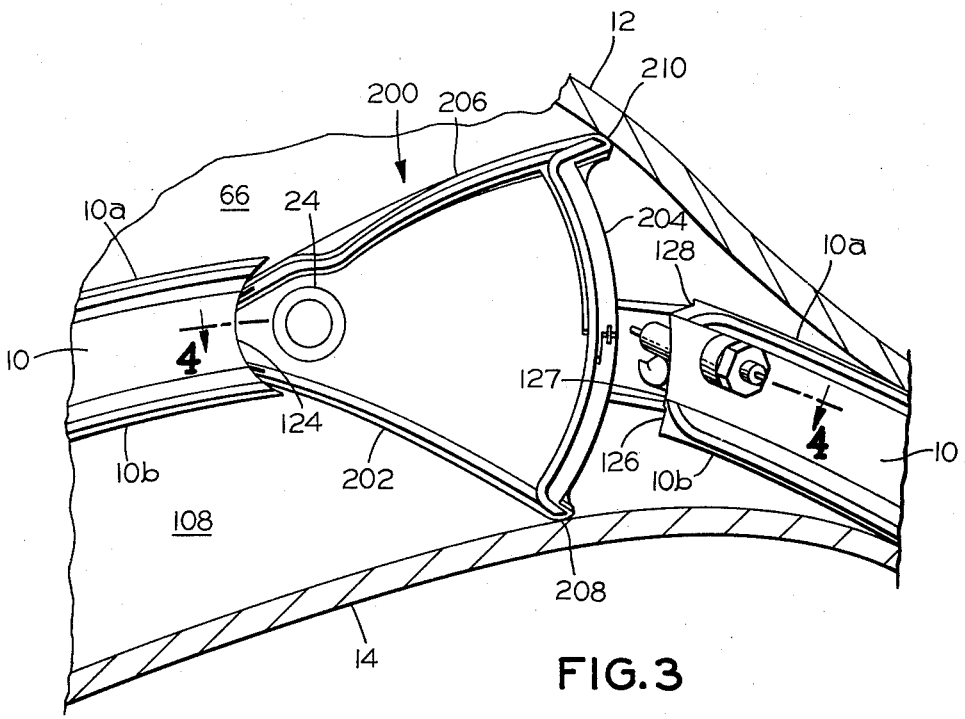
FIG. 3 is a horizontal sectional view taken through a portion of the rotary engine depicted in FIG. 1 revealing in greater detail the construction of an individual valve element.
Figure 5:
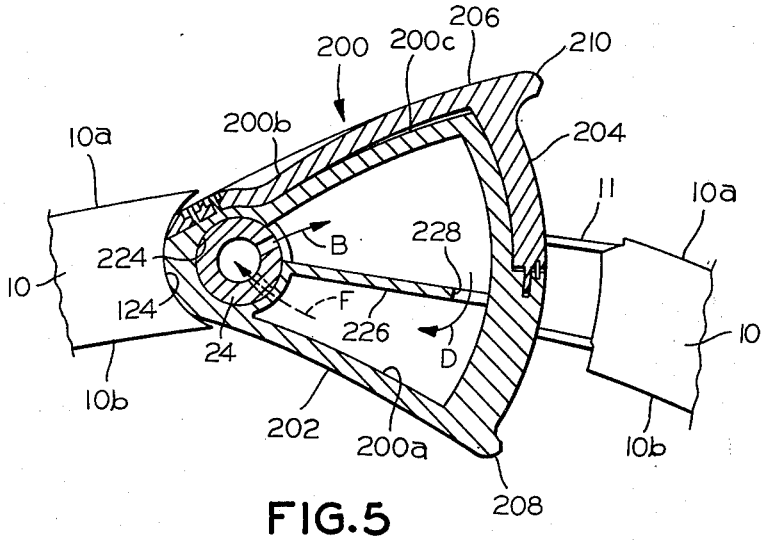
FIG. 5 is a horizontal sectional view through the valve element of FIG. 3.

FIGS. 3, 4 and 5 show in some detail the make-up of the preferred form of triangular valve element 200 adopted in the rotary engine of FIG. 1. Three such valve elements are used in this engine configuration, and each such valve element 200 is of generally triangular configuration when viewed from above, as for example in FIGS. 1 and 3. The valve 200 is pivotally supported on a vertically oriented pivot post or shaft 24 adjacent one of its three apexes, and the other two apexes define inner and outer vertically extending sealing surfaces, indicated generally at 208 and 210 respectively. As mentioned previously the inner side surface of the triangular valve element 202 cooperates with the hollow shaft 14 and with the cylindrical inner surface of the stator 10 to define a boundary of the continuously changing volume of the cavity or chamber 108. Similarly, the outer side surface 206 of the triangular valve element 200 cooperates with the inside surface of the outer rotor 12 in conjunction with the generally cylindrical external surfaces of the stator 10 to define boundaries of one or the other of the two external cavities or chambers 66 and 68. Actually, the valve element 200 in FIG. 3 is in position for ignition of the charge of fuel and air, in that portions of these chambers define the combustion chamber. The free side portion 204 of the valve element 200, and the stator 10, the outer rotor 12, and the inner shaft 14 all cooperate with one another at this point during the engine cycle to define the combustion chamber.

As best shown in FIG. 4, the valve element 200 includes a cylindrical bore, or opening 212, for receiving the pivot post 24, which post 24 is of hollow configuration and adapted to direct a quantity of cooling fluid in the direction of the arrows labelled A, B, C and D in FIG. 4. As the valve oscillates between its limit positions, best shown in FIG. 1, inlet and outlet ports, defined in the fixed pivot post 24, permit this cooling fluid to be directed through the hollow interior of the triangular valve element and to be exhausted downwardly through the lower hollow portion of the pivot post 24 as indicated by the arrows E and F in FIG. 4.

As mentioned previously the valve element 200 is self-operated, that is said valve element moves between the limit positions depicted for it in FIG. 1 in response to engagement between the inner sealing surface 208 and the shaft 14, and the outer surface 210 and the rotor 12. Actually, these sealing surfaces 208 and 210 are defined on inner and outer projecting flanges at the corners, or apexes, of the triangular valve element 200, and these flanges are also adapted to engage inner and outer sealing surfaces 126 and 128 defined adjacent the inner and outer boundaries of an associated valve opening. More particularly, the inner projecting flange is adapted to engage the inner boundary 126 of the stator opening when the triangular valve element is pivoted to its outer limit of travel best shown at the bottom of the FIG. 1 view. The outer projecting flange at the outer apex of the triangular valve element is adapted to engage the outer boundary or seating surface 128 when the valve element 200 is pivoted to its inner limit of travel, as shown at the right hand side of the FIG. 1 view of this engine. In these particular limit positions it will be apparent that the inner side surface 202 of the valve element 200 is provided with a concave contour matching that portion of the hollow shaft 14 which it is adapted to engage, and that the outer surface 206 of the valve element has a convex contour adapted to match the generally cylindrical portion of the inside surface of the stator.

As best shown in FIG. 3 seals are provided in the top surface of the triangular valve element 200, an outer segment being located adjacent its outer convex side surface and an inner seal adjacent its inner concave side surface. Additionally, a sealing segment is also provided along its free side portion 204 and similar seals are also provided in the bottom surface of said triangular valve element 200 as suggested in FIG. 4. Vertically extending seals are provided at the third apex of the triangular valve element 200 associated with the pivot post 24, and these vertically extending seals are adapted to engage a cylindrically shaped boundary 124 of the valve opening defined in the stator 10, which boundary 124 in cooperation with said vertically extending seals isolates this end of the valve.

Figure 5A:
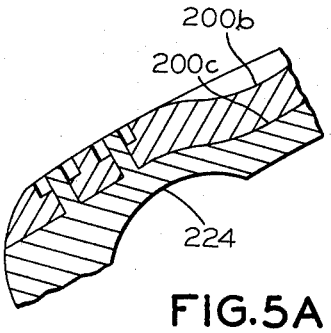
FIG. 5A is a detailed view of a portion of the valve element shown in FIG. 5.
Figure 5B:
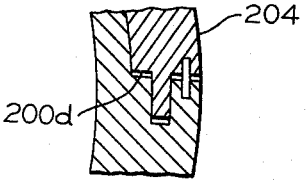
FIG. 5B is a detailed view of another portion of the valve element of FIG. 5.

Still with reference to the generally triangularly shaped valve element 200, FIG. 5 shows this component as being fabricated from at least two separate parts, one of which **200*a* defines the cylindrical bore 224 which permits the valve to be rotatably received on the post 24, and the other of which parts comprises a generally L-shaped part 200*b*, the legs of which define the outer convex surface 206 and at least a portion of the free side surface 204 of the valve element. More particularly, the larger of these two parts, that is the inner part 200*a* defines the inner concave side surface 202 of the valve element as well as the remaining portion of the free side surface 204. Additionally, this inner part 200*a* defines the hollow interior of the valve element, including an integral web 226 best revealed in FIGS. 4 and 5. Openings in this web 226 allow for circulation of the fluid through the valve generally, and as indicated by the arrow D in FIG. 5. As the valve changes position from that shown in FIG. 5 this fluid follows the direction of the broken line arrow F outwardly through the port provided for this purpose in the valve element itself, and in the fixed post 24 generally downwardly through the hollow post as indicated in FIG. 4 by the arrow E. Finally, and still with reference to the valve element 200, FIGS. 5A and 5B show details of the construction in those areas where the two individual valve parts are mated with one another. As suggested in FIG. 5 the L-shaped part 200*b* is somewhat flexible so that it can accommodate variations in thermal rates of expansion between the stator, the inner hollow shaft and the outer rotor (not shown in FIG. 5). A clearance is provided in the area indicated generally at 200*c* in FIG. 5 for this purpose. A similar clearance opening is provided in the area shown generally at 200*d* in FIG. 5B being more particularly the area between the outer end of the leg of L-shaped member 200*b* and the mating portion of the other valve part 200*a***.

By way of summary then the improved triangular valve of the present invention is so constructed and arranged as to serve a similar function as that for the abutment in my prior issued U.S. Pat. No. 3,230,938.

More particularly, the outer sealing surface 210 continuously engages the cylindrical inside surface of the rotating outer rotor 12. The inner sealing surface 208 of valve 200 continuously contacts the cylindrical outer periphery of the hollow shaft 14. These counter rotating surfaces confine the triangular valve to oscillatory motion between the limit positions depicted for it in FIG. 1, and from that view it will also be apparent that the free side portion or face 204 of the valve element acts in the nature of the head of a piston in a conventional reciprocating engine except that the expanding charge imparts motion to the outer rotor 12 in the direction of the arrow 13. The pressure on the triangular valve element tends to cause these sealing surfaces 208 and 210 to remain in engagement with the inner shaft 14 and outer rotor 12.

The rotary engine depicted herein has all of the usual advantages of rotary engine designs generally, including that of permitting a degree of compression of the air charge prior to combustion, which compression is independent of the degree of expansion required in absorbing the energy of the burning fuel and air mixture. In terms of engine efficiency it is well known that the compression ratio and the expansion ratio are determinative of the thermal efficiency of an internal combustion engine whether of the rotary or conventional piston type. One advantage of the former over the latter is that its construction permits the expansion ratio to be greater than the compression ratio. Since the compression ratio is inherently limited as a result of the fuel used in any internal combustion engine, it follows that the rotary engine is inherently more efficient because the expansion ratio is independent of the compression ratio. The design of the rotary engine disclosed herein not only permits a large expansion ratio but does so without the bulky size normally associated with a rotary engine. It will be apparent that the expansion ratio is directly related to the size of the expansion chamber. Most rotary engines achieve a high expansion ratio by providing for a relatively large cavity in the rotating member. In the engine shown, on the other hand, the expansion ratio may be materially increased by increasing the diameter of the rotor. However, it should be noted that this approach would require a stator of increased size creating balancing problems as well as large and heavy bearings or the like. The design depicted herein seeks to optimize the volume of the outer cavity 66 and 68 without incurring any size or weight penalty by providing the triangular valve elements pivoted in the stator, and having associated valve sealing surfaces so arranged with respect to the radial direction of the overall engine that the volumes of these outer cavities are optimized. As so constructed and arranged, the effective expansion ratio is materially increased over that possible with reciprocable valve elements of the type shown in some prior art rotary engines.

Figure 2:
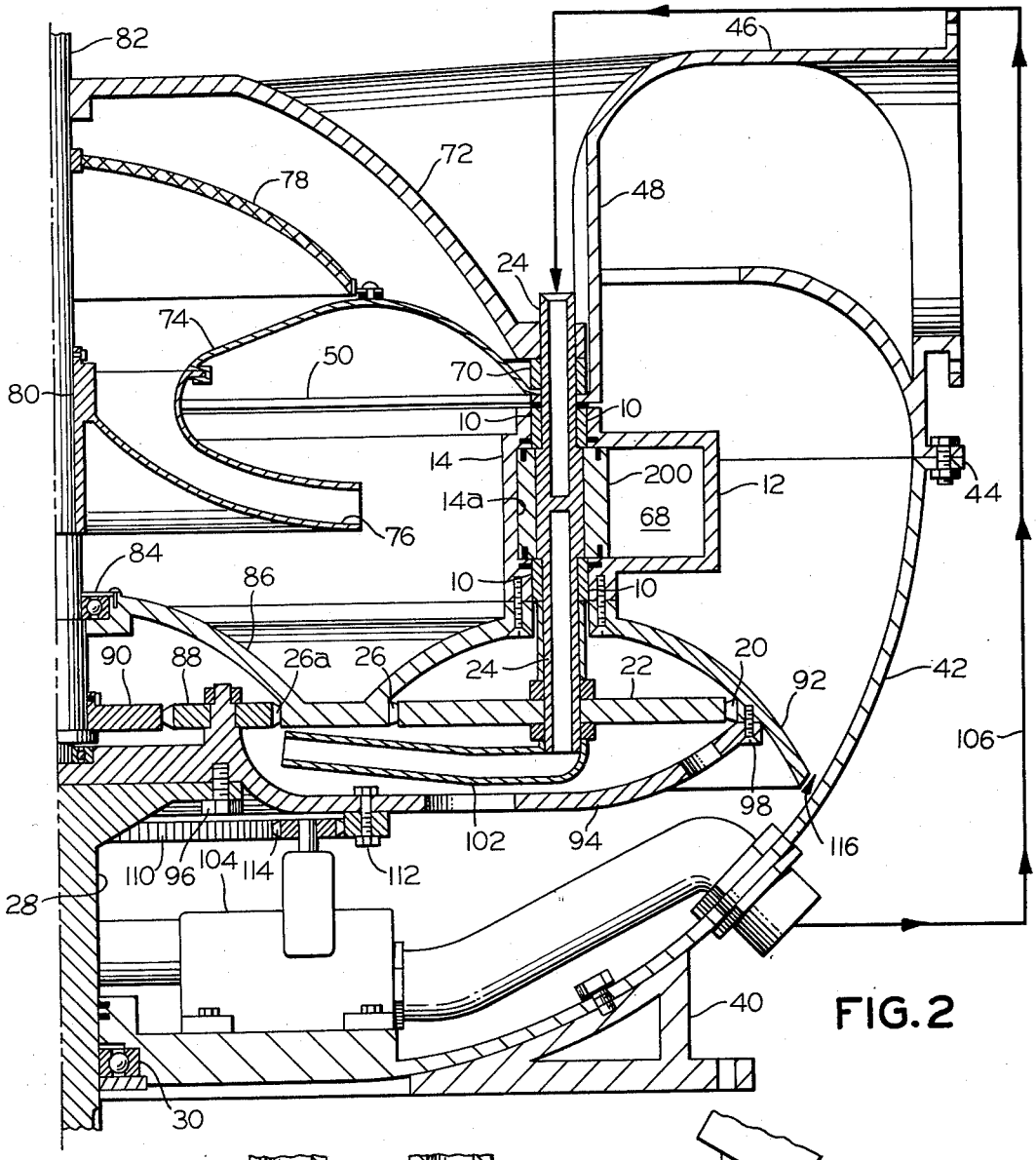
FIG. 2 is a vertical sectional view through the right hand portion of the rotary engine shown in FIG. 1 being taken generally on the line 2—2 of that view.
Figure 6:
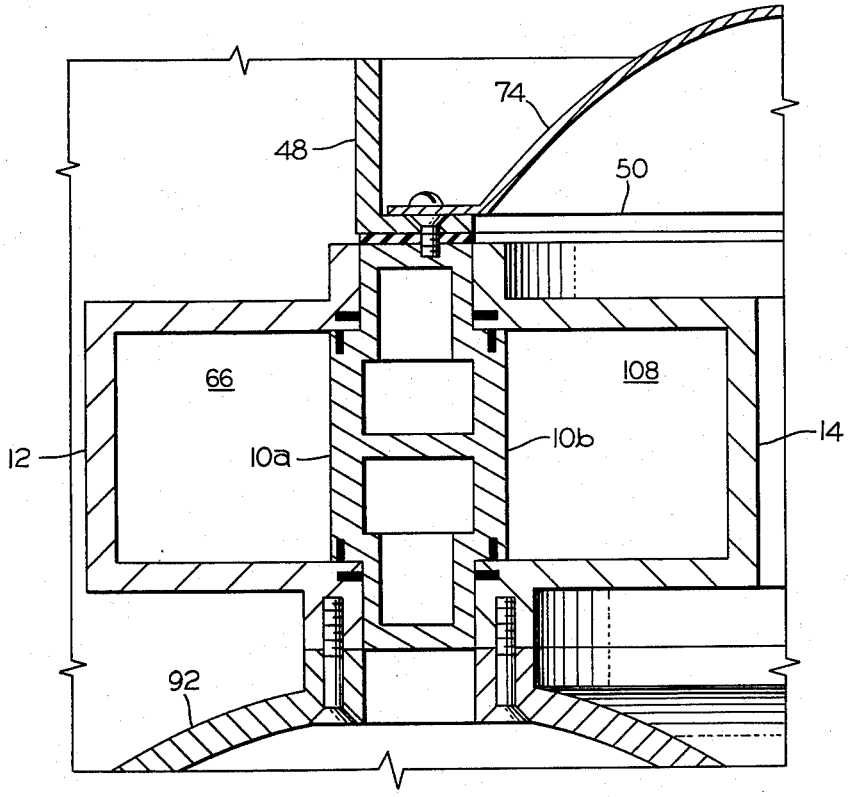
FIG. 6 is a vertical sectional view through a left hand portion of the rotary engine in FIG. 1, being taken generally on the line 6—6 of that view.

Referring now to FIGS. 2 and 6 in greater detail, a primary engine drive or output shaft is indicated generally at 28, and is rotatably supported adjacent its lower end in a bearing 30 provided in a fixed base structure 40. This shaft 28 is directly driven by the ring gear 20 through a dish shaped member 94 to be described. The base 40 has an upwardly facing surface adapted to receive a bowl shaped housing 42, which housing 42 includes a peripherally extending flange 44 adapted to receive a mating flange on an annular exhaust plenum 46. The exhaust plenum 46 includes an inner depending wall 48, the lower end of which defines a radially inwardly generally horizontally extending flange 50. The flange 50 is circular in configuration and of generally the same diameter as is the fixed stator 10. The stator 10 appears in FIG. 2 only in segmented fashion, but FIG. 6 shows the flange 50 attached to the stator 10, and FIG. 4 taken along a vertical plane normal to that of FIG. 6 shows in greater detail the configuration of the stator 10. FIG. 6 shows the annular stator 10 as having a cross sectional shape which includes inner and outer annular ribs, 10b and 10a respectively, which ribs act as tracks for rotatably receiving the inner shaft 14 and the outer rotor 12 in a manner to be described in greater detail hereinbelow.

With particular reference to FIG. 4, the stator is hollow in configuration and adapted to be cooled by the introduction of a suitable fluid through the conduit 52 provided in its upper surface adjacent the pivot post 24, which fluid is adapted to be vented through a vent opening 54 at the lower face of the stator 10. Still with reference to FIG. 4, the stator 10 includes upper and lower bosses, 56 and 58, for receiving the fuel injection nozzle and glow plug, 136 and 134 respectively. The nozzle 137 and the glow plug 134 extend inwardly into the combustion chamber defined between the free side or face 204 of the valve element 200, and the boundary 127 of the valve opening defined in the stator. The opposite boundary 124 of this stator opening is also shown in FIG. 4, and mates with the convex apex of the triangular valve element described previously. As seen in FIG. 4 the valve opening defined in the stator 10 also includes upper and lower boundaries which correspond in vertical dimension to the height of the valve element 200. Thus, the valve element 200 is effectively captured in this opening, and is free only to oscillate in the manner described above. With reference to FIG. 2 it should also be noted that the valve 200 is also slidably radially but restrained vertically as it is oscillated by the counterrotating inner hollow shaft 14 and the outer rotor 12.

As best shown in FIGS. 2 and 6, with reference to the rotor 12, the cavity 68 defined therein is more particularly defined by the generally C-shaped rotor segment, which rotor is of one piece construction, and the upper and lower legs of said C-shaped rotor engine the upper and lower faces of the valve element 200 not shown in FIG. 6. In further accordance with the present invention the stator 10 has a radially outwardly projecting annular rib 10a best shown in FIG. 6 for receiving said C-shaped portion of said outer rotor, which rib 10a extends at least throughout those segments of said stator which do not define the valve openings. This configuration provides an effective annular sealing surface throughout the peripheral extent of the stator. Annular sealing means is provided in this annular surface, that is in the annular rib 10*a* on the stator in order to isolate the outer cavities 66 and 68 especially during the compression and expansion portions of the engine's rotational cycle.

A similar annular rib 10b is provided on the inner cylindrical surface of the stator 10, and mates with a correspondingly shaped recess of C-shaped configuration defined in the outer periphery of the hollow shaft 14. This C-shaped recess in the hollow shaft 14 is best shown in FIG. 6, and serves the same purpose as the C-shaped portion of the rotor 12 described hereinabove. The vertical dimension of the C is the same to accommodate the vertical height of the valve 200. Thus, the expansion and compression chambers 66 and 108, in which the valve 200 (not shown) is adapted to oscillate during operation of the engine, are both shown in FIG. 6, and FIG. 2 shows a segment of the valve.

Referring now to the means for pivotally supporting the valve elements in their respective openings, the inwardly extending annular flange 50 of the exhaust shroud described above, not only supports the stator 10, but also supports the hollow pivot post 24 associated with the valve element 200. As shown in FIG. 2 the upper end of the post 24 not only extends through a circular opening provided for this purpose in the stator 10, but also through an aligned opening in the flange 50, and through similarly aligned openings in a spacer 70 and a support member 72. Three such support members 72, 72 are provided, and one such member 72 is associated with each of the three posts 24, 24. An inlet shroud 74 is also provided with an opening for each post 24, and said shroud 74 is also supported from the rib 50 on the exhaust shroud. The shroud 74 defines an annular opening 76 at the lower portion of the inlet shroud 74 and has an inlet screen 78 provided upstream of said annular opening 76 in order to filter inlet air delivered to the engine. It will be apparent that the annular member defining the opening 76 might comprise a centrifugal blower mounted directly to the auxiliary shaft 82, and that such a feature would be a very convenient means for delivering supercharged air to the intake scoop 110 of the hollow shaft 14.

The inlet shroud 74 also includes an annular member 80 supporting an auxiliary output shaft 82, which auxiliary shaft 82 is adapted to rotate at a higher speed than that of the shaft 28 referred to previously. The high speed or auxiliary output shaft 82 is rotatably supported in a bearing 84 adjacent its lower end, which bearing 84 is in turn carried by an inwardly extending flange 86 driven at the same speed as the hollow shaft 14. The sun gear 26 referred to previously is defined on this flange 86, and a secondary gear 26a comprises part of a secondary gear train to drive the auxiliary high speed output shaft 82. This secondary, or auxiliary planetary gear train includes one or more planetary gears such as shown at 88, rotating in driving engagement with a sun gear 90 carried directly by the auxiliary shaft 82. By appropriately choosing the relative diameters of these gears 90, 88 and 26*a* it will be apparent that the rotational speed of the high speed output shaft 82 can be determined not only with respect to the primary output or drive shaft 28, but also with respect to the speed of movement of the hollow shaft 14. Preferably, the speed of auxiliary output shaft 82 will be the same as that of shaft 14.

Still with reference to FIG. 2, a depending flange structure 92, associated with the lower portion of the rotor 12, defines the ring gear 20 associated with the primary planetary gear train system, and a direct connection is provided between said flange 92 and the drive shaft 28 of the engine by means of the dish shaped member 94 mentioned previously. This dish shaped member 94 is bolted, at its inner end, to the shaft 28 by bolts 96, 96 and is attached to the depending flange 92 by screws 98, 98. The pivot post 24 carries at its lower end the planetary gear 22 referred to previously, which gear 22 meshes with the gear 26 defined by flange 86 associated with the hollow shaft 14, and which planetary gear 22 also meshes with the ring gear defined by flange 92 associated with the outer rotor 12. As so constructed and arranged it will be apparent that the relative diameters of these gears can be so chosen that the speed of the inner shaft 14 is twice that of the rotor 12 and opposite in direction.

Still with reference to the hollow pivot post 24 and as mentioned hereinabove, a fluid, such as lubricating oil, is adapted to be directed downwardly through the upper end of the hollow post 24 through the hollow valve element 200 and thence downwardly through the lower portion of the pivot post 24 where a guide tube 102 is adapted to direct such fluid generally toward the planetary gear 88 associated with the secondary or auxiliary drive shaft train. Openings are provided in the dish shaped member 94 so that such oil eventually passes downwardly inside of the bowl shaped housing 42. A scavenge pump 104 is adapted to pick up such oil, filter it, and recirculate this oil through a line, depicted schematically at 106, outside of the bowl shaped housing 42 and thence downwardly through the upper end of the hollow pivot post 24 associated with each of the three valve elements 200, 200. The scavenge pump 104 is adapted to be driven through a ring gear 110 bolted to the underside of the dish shaped member, as indicated by the bolts 112, 112. A pinion gear 114 meshes with the gear 110 and turns a shaft associated with the positive displacement vane type scavenge pump 104. During operation of the engine the bowl 42 would be at least partially filled with oil, up to within a predetermined distance below the dish 94, and any exhaust fumes which might condense on the inside surface of the shroud 46 would be carried downwardly and thereby mixed with the lubricating oil. A space 116 is preferably provided between the lower edge of the depending flange 92 and the inside of the bowl 42 for this purpose.

Although the rotary engine shown and described in this application is intended to be cooled and lubricated by a fluid such as lubricating oil, or more accurately an oil mist, it will be apparent that a large part of the cooling requirements might be met by the use of an air cooled stator. In such case, the valve pivot post or rock shaft 24 could be made solid, and the valves and the stator made hollow so that cooling air could be directed downwardly therethrough. Other modifications of my rotary engine will occur to those skilled in the art of internal combustion engines and air pumps, and rather than enumerate all of the variations and modifications which might be apparent from this disclosure, I rely on the following claims as determinative of the scope of my invention.

I claim:

1. A rotary engine comprising an annular stator having circumaxially spaced valve openings, a hollow shaft rotatably received inside said stator and defining at least one compression cavity between said shaft and said stator, an outer rotor rotatably received outside said stator and defining at least one expansion cavity between said rotor and said stator, means for rotatably interconnecting said shaft and rotor for rotation in opposite directions, a generally triangular valve element in each of said valve openings and having three apexes, a projecting flange at one of said apexes defining an inner sealing surface engaging said shaft, a projecting flange at a second apex of said valve element defining an outer sealing surface for engaging said rotor, and an arcuate convex corner at a third apex of said valve element and cooperating with a concave end of said valve opening in said fixed stator to define a pivot axis for said valve element adjacent one end of said valve opening whereby the valve element oscillates in the plane defined by said three apexes and in response to said oppositely rotating shaft and rotor, and each valve element further including a free side portion between said inner and outer first and second apexes respectively, said free side portion being spaced circumaxially from the end of said valve opening opposite said one end whereby the compressed charge formed in said compression cavity moves radially outwardly into said expansion cavity as said shaft and rotor oscillate said valve element, said stator having inner and outer recesses adjacent said opposite end of said valve opening for receiving said projecting flanges at the inner and outer limits of travel for said valve element in said opening, and said triangular valve element including an inner side portion between said third apex associated with said pivot axis and said inner apex associated with said inner sealing surface, said inner side portion of said valve element having a slightly concave contour to mate with the generally cylindrical contour of said hollow shaft.

2. A rotary engine as set forth in claim 1 wherein said outer rotor is of generally annular plan form except where its inner periphery departs therefrom to define said expansion cavity, said expansion cavity having a generally C-shaped radial cross sectional configuration, and said stator having a radially outwardly projecting annular rib for receiving said C-shaped expansion cavity defining portion of said rotor, and outer sealing means associated with said annular rib to isolate said expansion cavity during at least a portion of the engines rotation cycle, whereby that portion of said triangular valve element defining said second apex thereof engages only said outer rotor during its oscillatory movement.

3. A rotary engine as set forth in claim 2 wherein said hollow shaft is generally annular in plan form except for a portion defining said compression cavity, said portion of said hollow shaft having a generally C-shaped radial cross sectional configuration, and said portion of said shaft protruding radially inwardly in a manner which departs from said annular plan form, said stator having a radially inwardly projecting annular rib for receiving said C-shaped portion of said hollow shaft which rib extends at least through that portion of said shaft not defining said valve openings, and inner sealing means associated with said inwardly projecting annular rib to isolate said compression cavity during at least a portion of the engines rotation cycle, whereby that portion of said triangular valve element defining said one apex engages only the said C-shaped hollow shaft as the valve element oscillates.

4. A rotary engine as set forth in claim 3 wherein each of said triangular valve elements further includes an outer side portion between said third apex associated with said pivot axis and said second apex associated with said outer sealing surface, said outer side portion having a slightly convex contour to mate with the generally cylindrical contour of said outer rotor.

5. A rotary engine as set forth in claim 3 wherein said triangular valve element comprises at least two parts, one of said parts defining a cylindrical opening, a pivot post defining the axis of oscillatory valve movement, said one valve part for said pivot post also defining an inner side portion of said valve element, and said other valve part cooperating with said one part to define said free side portion, and an outer side portion between said third apex and said second apex associated with said outer sealing surface also defined by said other valve part, said other valve part having a generally L-shaped configuration with the legs of the L defining at least a segment of said valve free side portion.

6. A rotary engine as set forth in claim 3 wherein said means for rotatably connecting said shaft to said rotor comprises a planetary gear means adapted to limit the ratio of the angular speeds of each so as to bear a relationship to one another which is a whole integer, and wherein the number of said expansion cavities bears the same integer ratio to the number of said compression cavities, said speeds of said shaft and rotor being measured relative to said stationary stator.

7. A rotary engine as set forth in claim 6 wherein said planetary gear means comprises a sun gear carried by said hollow shaft and a ring gear carried by said outer rotor, said gear means being provided below said shaft, stator, and rotor, and an output shaft driven from said hollow shaft.

8. A rotary engine as set forth in claim 7 wherein said planetary gear means further includes a plurality of planetary gears, a pivot post mounted in said stator and defining said valve pivot axis each of said planetary gears rotatably supported on a depending portion of one of said pivot posts associated with one of said valve elements.

9. A rotary engine as set forth in claim 8 wherein an exhaust shroud of annular configuration is provided on the upper face of said stator, and a base for said engine defining a bearing for said output shaft and including an outer periphery mounted to the lower annular periphery of said exhaust shroud.

10. A rotary engine as set forth in claim 9 wherein each of said pivot posts associated with each of said valve elements has an internal bore extending at least partially through said post, and means for circulating fluid through said bore.

11. A rotary engine as set forth in claim 9 wherein said means for circulating fluid includes a scavenge pump mounted to said base, and fluid passageway defining means for circulating fluid from said pump to the upper end of said post.

12. A rotary engine as set forth in claim 11 wherein each of said valve elements is hollow and includes ports communicating with ports in said pivot posts in order to permit fluid to pass from said pivot post bore into said valve interior and thence to return to said bore whereby to cool said valve element.

* * * * *